US005582403A

United States Patent [19]

George

[11] Patent Number: 5,582,403

[45] Date of Patent: Dec. 10, 1996

[54] BASEBALL TRAINING AND EXERCISE APPARATUS

[76] Inventor: Robert George, 1615 Avenue I, Apt. 125, Brooklyn, N.Y. 11230

[21] Appl. No.: 378,621

[22] Filed: Jan. 26, 1995

Related U.S. Application Data

[62] Division of Ser. No. 147,971, Nov. 5, 1993, abandoned.

[51] Int. Cl.[6] ..... A63B 69/40

[52] U.S. Cl. ..... 273/26 R; 273/29 A

[58] Field of Search ..... 273/26 R, 26 A, 273/29 A, 191 B

[56] References Cited

U.S. PATENT DOCUMENTS

| | | |
|---|---|---|
| 805,543 | 11/1905 | Hayes . |
| 3,427,021 | 2/1969 | Donato . |
| 3,731,926 | 5/1973 | Vincent . |
| 3,794,320 | 2/1974 | Salmont . |
| 3,876,203 | 4/1975 | Gold . |
| 4,042,237 | 8/1977 | Moraru . |
| 4,089,521 | 5/1978 | Berst et al. . |
| 4,105,203 | 8/1978 | Cho . |
| 4,105,204 | 8/1978 | Koenig . |
| 4,258,916 | 3/1981 | Beam . |
| 4,508,340 | 4/1985 | Liao . |
| 4,533,138 | 8/1985 | Rodriguez, Jr. et al. . |
| 4,641,834 | 2/1987 | Hegedüs et al. . |
| 4,907,801 | 3/1990 | Kopp . |

FOREIGN PATENT DOCUMENTS

| | | |
|---|---|---|
| 2239182 | 6/1991 | United Kingdom . |

*Primary Examiner*—Theatrice Brown
*Attorney, Agent, or Firm*—Hoffmann & Baron

[57] ABSTRACT

A baseball training and exercise device includes a base, a first columnar support and a second columnar support telescopically positioned within the first support. The exercise device also includes a first arm having a first end coupled to the second support. The arm extends radially outward from the second support. A resiliently supported ball portion is positioned to extend beyond a second end of the arm. The resiliently supported ball portion provides resistance against a baseball bat or the like contacting the ball portion of the baseball training and exercise device.

10 Claims, 4 Drawing Sheets

BASEBALL TRAINING AND EXERCISE APPARATUS

This is a divisional application of application Ser. No. 08/147,971 filed on Nov. 5, 1993, now abandoned.

BACKGROUND OF THE INVENTION

1. Field of the Invention

The present invention relates to exercise equipment, and more particularly relates to a baseball training and exercise apparatus to improve strength and batting skills.

2. Description of the Prior Art

Exercise machines for increasing strength are well known in the art. Exercise devices for increasing body strength include free weights, weight machines and isometric devices. A baseball player may use any or all of the above-identified exercise means in order to increase strength to create a more powerful swing.

One of the disadvantages of building strength through the use of weights or weight machines is that batting skills, and particularly hand/eye coordination, are not improved. Known exercise devices for increasing strength require little or no coordination and are merely repetitive exercises having no nexus with the skills required for batting. Thus, in order to improve batting skills, devices such as batting tees and pitching machines for batting practice are commonly used.

One of the most important skills a baseball batter requires is hand/eye coordination. An effective batter must make contact between a cylindrical portion of a barrel of a baseball bat and a round baseball sometimes traveling in excess of 90 miles an hour. Hitting a baseball has been said to be one of the most difficult skills in any sport. To improve hand/eye coordination and become a better hitter, most baseball players use pitching machines or batting tees to practice their swing and improve coordination. This type of batting practice may increase a ball player's ability to make contact with a pitched baseball; however, these exercises do not substantially increase the strength of the ball player. Accordingly, although the ball player may become more adept at making contact with the baseball, he will still need to work out with an exercise machine or weights to increase body strength. It is desirable to increase body strength to thereby increase bat speed and power when batting.

Accordingly, it would be advantageous to have an exercise apparatus which increases body strength while at the same time improves a ball player's batting skills, including hand/eye coordination. In this manner, a single exercise session would both increase a batter's power as well as his ability to make contact with a pitched ball.

OBJECTS AND SUMMARY OF THE INVENTION

It is an object of the present invention to provide a baseball training and exercise apparatus which is directed to improving both body strength and batting skills.

It is another object of the present invention to provide a method of exercising which will improve a baseball player's batting skills and strength, with a single exercise.

In accordance with one form of the present invention, the baseball batting exercise apparatus includes a base, a support coupled to the base and a first arm having a first end coupled to the support. The first arm extends radially outward from the support and includes a second end opposite the first end.

The support may further include a first columnar portion and a second columnar portion adjustably mounted to the first columnar portion to allow the height of the support and said first arm to be adjusted. The exercise apparatus further includes a bat striking assembly, the bat striking assembly including a ball portion and means for resiliently supporting the ball portion, the striking assembly being mounted on and situated near the second end of the first arm. The resilient supporting means provides resistance against a baseball bat or the like contacting the ball portion of the exercise apparatus.

The resilient supporting means for the ball portion may be in the form of a spring, a piston-like shock absorber, elastic bands or any other suitable resilient supporting means. Additionally, the first arm of the baseball batting exercise apparatus may include a stopper means positioned at the second end of the arm for stopping the ball portion from being pushed into or against the end of the arm. Furthermore, the first arm may be pivotally mounted on the support to allow for different swing angles when contacting the ball portion of the device.

In an alternative embodiment, a baseball batting exercise apparatus formed in accordance with the present invention further includes a means for holding at least one weight plate on the base of the apparatus. The means for holding the at least one weight plate serves as both a storage area for weight plates as well as providing additional stability to the exercise apparatus when the ball portion of the apparatus is struck by a baseball bat or the like.

The baseball exercise apparatus may also include a means for providing resistance to a baseball bat held by a user of the apparatus. The resistance means may be coupled to the support such that the resistance means provides resistance against swinging a baseball bat or the like to contact the ball portion of the exercise apparatus. The means for providing resistance may include a second arm coupled to the support and extending outwardly therefrom. The second arm may include a pulley or the like attached to a distal end of the arm and a cable positioned at least partially around the pulley. The cable includes one end coupled to a means for providing resistance and the other end coupled to a means for selectively securing a baseball bat or the like to the end of the cable. The means for providing resistance may be a means for holding at least one weight plate, a biasing means or any other means which can provide resistance to swinging the baseball bat or the like.

The present invention is also directed to a method of improving baseball batting skills and strength including the steps of providing a baseball batting exercise apparatus having the structure described above and swinging a baseball bat or the like to contact the resiliently supported ball portion of the baseball batting exercise apparatus. The resiliently supported ball portion provides resistance against a follow-through of the swing. As previously described, the baseball exercise apparatus may further include means for providing resistance selectively coupled to the baseball bat or the like which provides resistance against swinging the baseball bat. In this manner, batting skills such as hand/eye coordination as well as arm and shoulder strength may be improved by performing a single exercise.

In yet an alterative method of improving baseball batting skills and strength, the method includes providing a baseball batting exercise apparatus as previously described, contacting the resiliently supported ball portion of the exercise device with a baseball bat or the like such that the exerciser's arms are extended holding the baseball bat substantially parallel to the floor, and the exerciser turning over his wrists to push the baseball bat against the ball portion of the apparatus. The striking assembly including the resiliently supported ball portion provides opposing resistance thereto thereby providing an isometric exercise to increase strength in the exerciser's forearms and shoulders.

A preferred form of the baseball batting exercise apparatus, as well as other embodiments, objects, features and advantages of this invention, will be apparent from the following detailed description of illustrative embodiments thereof, which is to be read in connection with the accompanying drawings.

DETAILED DESCRIPTION OF THE PREFERRED EMBODIMENTS

Figure 1:
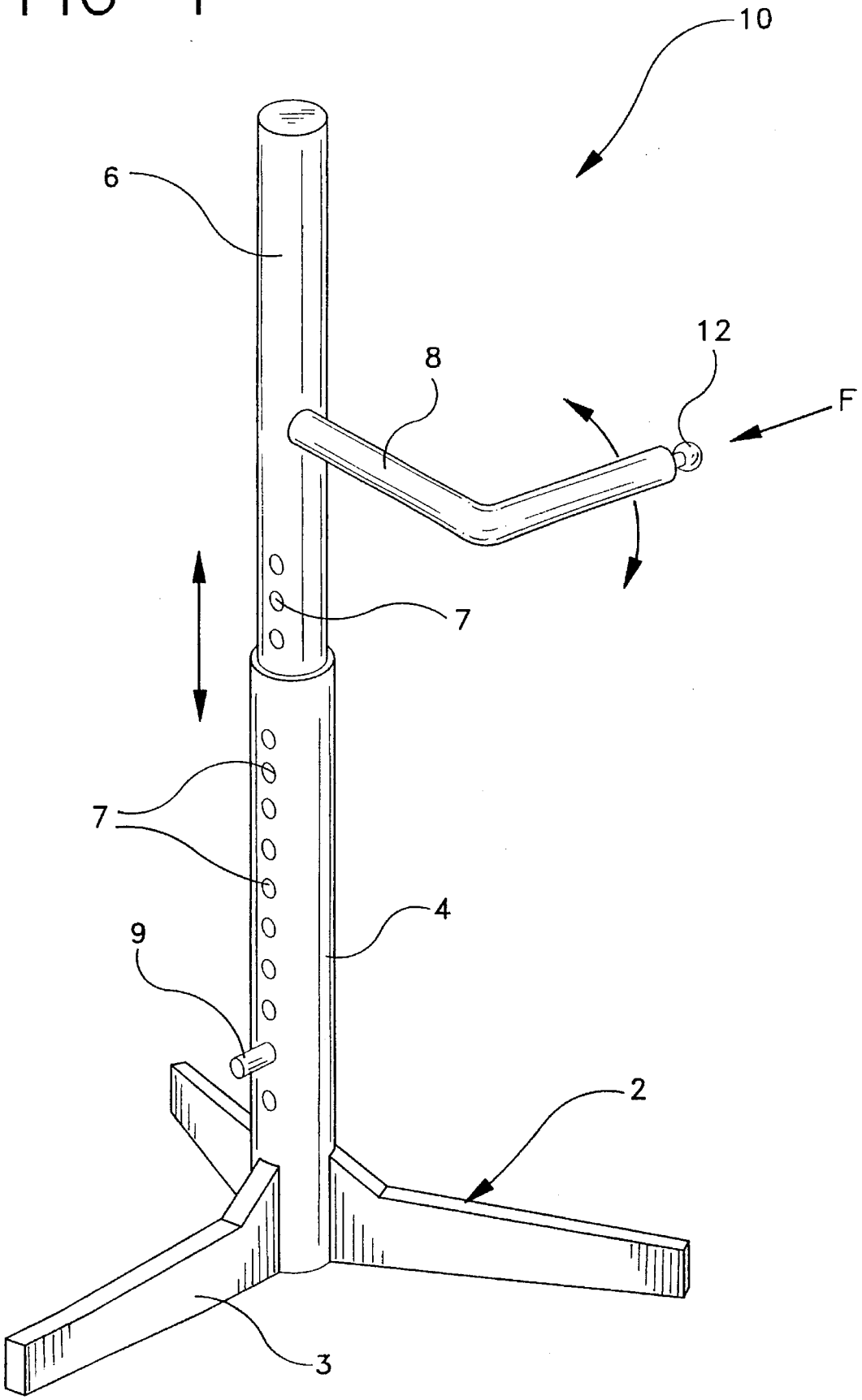
FIG. 1 is a side perspective view of the baseball training and exercise apparatus formed in accordance with the present invention.

Referring to FIG. 1, a baseball training and exercise apparatus constructed in accordance with the present invention basically includes a base 2, a first support means 4 coupled to the base, a second support means 6 slidably, telescopically received by the first support means 4 and a first arm 8 having a first end coupled to the second support means 6, the arm extending radially outward from the second support means. The 15 first arm 8 includes a bat striking assembly which includes a means for resiliently supporting a ball portion 12 extending beyond a second end of the arm 8.

In one preferred form, the base 2 comprises three radially extending feet 3 spaced approximately 120° apart from each other. Furthermore, one of the feet extends in a direction opposite from the direction in which the ball portion 12 extends beyond the second end of the arm 8. This configuration provides stability to the baseball training and exercise apparatus when a baseball bat or the like is used to strike or contact the ball portion 12 of the apparatus.

Figure 3:
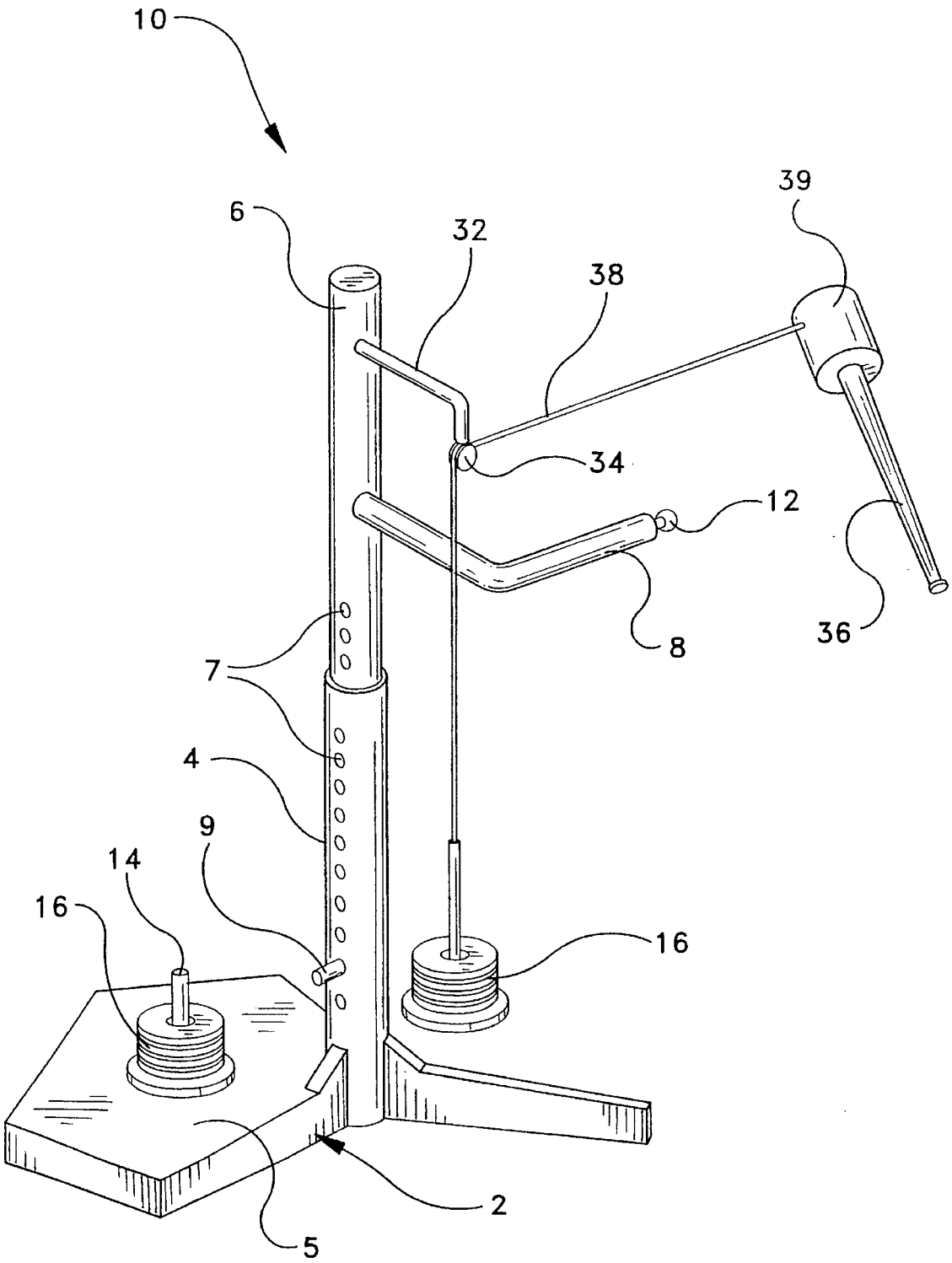
FIG. 3 is a side perspective view of an alternative embodiment of the baseball training and exercise apparatus formed in accordance with the present invention.

As shown in FIG. 3, the base 2 may further include a means for holding at least one weight plate. The means for holding the at least one weight plate may be in the form of a platform 5 having a peg 14 extending therefrom so that the donut-shaped weight plates 16 can be stacked onto the peg 14 for storage. The additional weight provided to the base 2 by the weight plates 16 provides further stability to the baseball training exercise apparatus 10 against tipping or sliding along the floor when the ball portion 12 is struck or contacted by a baseball bat or the like.

As mentioned previously, the second support means 6 is slidably, telescopically received by the first support means 4. By slidably moving the second support means 6 within the first support means 4, the height of the arm 8 may be adjusted to accommodate the particular exerciser using the baseball training and exercise apparatus of the present invention. Accordingly, the baseball training and exercise apparatus 10 can be used by both little leaguers as well as major leaguers. Furthermore, the first arm 8 may be pivotally mounted to the support 6 to adjust the angle of the arm. The first arm 8 may include a means for selectively positioning the arm 8 at various angles depending upon the type of swing the batter is practicing.

As shown in FIG. 1, the first support means 4 may be a columnar structure having the feet 3 forming the base 2 coupled thereto. The columnar structure 4 is hollow and adapted for telescopically receiving the second support means 6. As previously mentioned, the second support means 6 is dimensioned to be slidably positioned within the columnar first support means 4 as shown in FIG. 1. A means for maintaining the adjusted height of the arm 8 is included on each of the first and second support means. More specifically, each of the first and second support means may include a series of bores 7 positioned longitudinally along each of the first and second support means. When the height of the arm 8 is adjusted, the bores 7 in the first support means 4 align with the bores 7 of the second support means 6 and a pin or peg 9 is inserted into the bores to maintain the proper height of the arm 8.

The baseball training and exercise apparatus formed in accordance with the present invention also includes a bat striking assembly having a resiliently supported ball portion 12. The bat striking assembly is mounted on and situated near a second end of the arm 8. The ball portion 12 is preferably dimensioned to be substantially the same size as an official baseball. For certain exercises using the apparatus of the present invention, the ball portion is removable and replaceable with a semi-circular concave structure adapted for receiving a barrel of a baseball bat.

Figure 2:
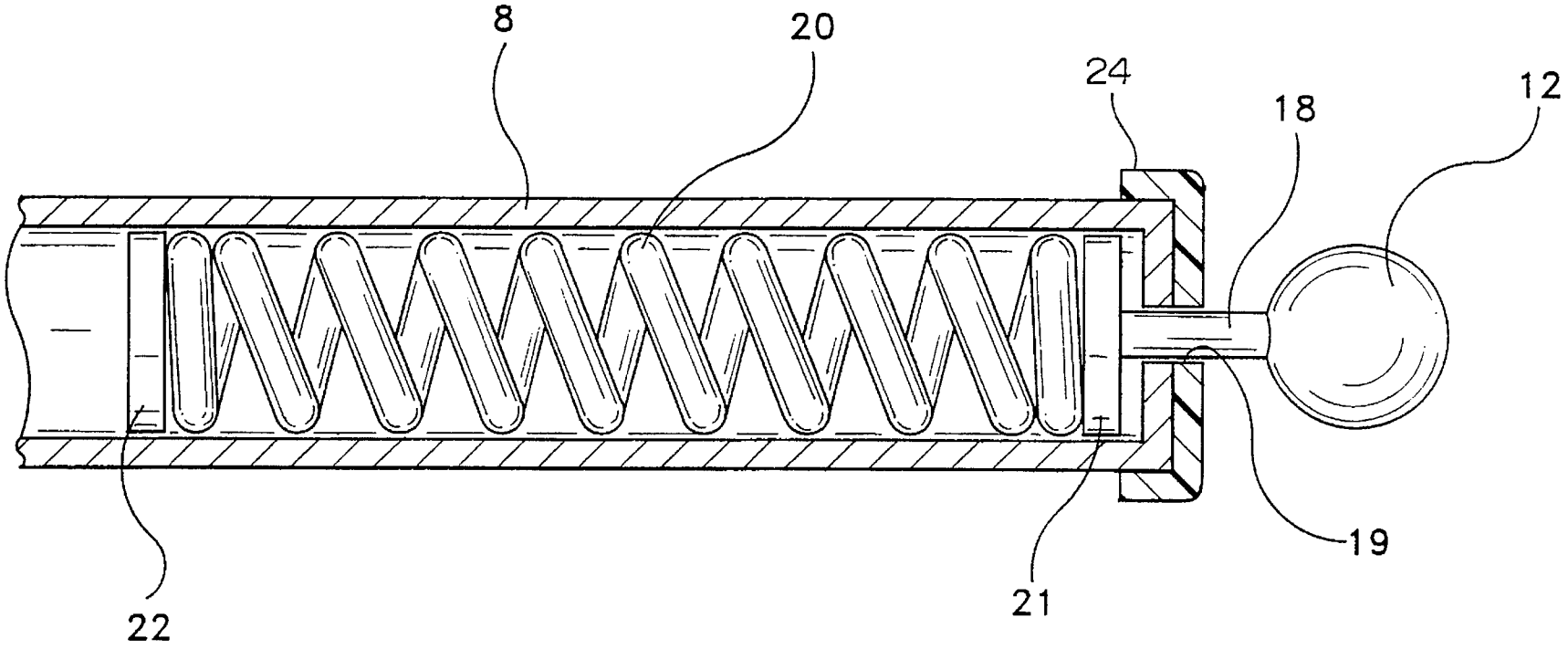
FIG. 2 is a partial cross-sectional view of the first arm which houses a ball portion of the baseball exercise apparatus formed in accordance with the present invention.

FIG. 2 illustrates a partial cross-section of the second end of the arm 8 including the bat striking assembly. The ball portion 12 is coupled to a rod 18 which extends through an opening 19 at the second end of the arm 8. The opening 19 in the second end of the arm 8 provides a guide for the rod as the ball portion or bat receiving structure is forced towards the end of the arm 8 by a baseball bat or the like contacting the ball portion. The rod 18 is coupled to a disc 21 at an opposite end from the ball portion 12. The disc 21 is in contact with a biasing means. In the illustrated embodiment shown in FIG. 2, the biasing means is a large spring 20. The arm 8 also includes a means for maintaining the position of the spring 20 within the arm. As shown in FIG. 2, the means is a hub 22 positioned within the arm 8. The hub 22 maintains the position of the spring within the arm 8 when the ball portion 12 is contacted by a baseball bat or the like thereby compressing the spring.

The apparatus of the present invention preferably includes means for adjusting the tension with respect to the bat striking assembly. More specifically, the spring 20 may be removable so that a variety of springs having more or less tension may be positioned in the bat striking assembly. In this manner, the baseball training and exercise apparatus can be adapted for any strength level of the ball player using the device.

Accordingly, when the ball portion 12 is forced in a direction toward the second end of the arm, the spring 20 compresses and provides a force in a direction opposite to the force applied to the ball portion 12. The second end of the arm may also include a stopper means 24 which covers the end of the arm. The stopper means 24 is preferably formed from an elastomeric material, such as rubber, to provide a cushioning effect if the ball portion 12 were to come in contact with the stopper means. The stopper means 24 also includes a bore therethrough so that the rod 18 coupled to the ball portion 12 can slide therein.

In an alternative embodiment, the spring 20 may be replaced by a piston-like shock absorber (not shown) similar to that used in an automobile. The piston-like shock absorber functions in a similar manner to the spring described above, and may use compressible gas to exert a counterforce on the ball portion 12. A ball portion 12 may be attached to the rod of the piston which compresses the gas when the ball portion is struck. The piston body may be bolted to the arm to hold the shock absorber in position. The shock absorber provides resistance against the ball portion being forced in a direction towards the second end of the arm. The shock absorber would preferably be designed to have memory to force the ball portion back to its original position once a force by a baseball bat or the like is removed. Thus, the baseball training and exercise apparatus 10 may include any known means to resiliently support the ball portion within the first arm of the device.

In another alternative embodiment, the bat striking assembly may include elastic bands (not shown) which provide resistance against forcing the ball portion towards the second end of the arm. More specifically, elastic bands may have one end attached to the second end of the arm and a second end attached to a disc which is adapted to axially slide within the arm. The ball portion may include an extended rod or shaft between the ball portion and the disc. Upon striking the ball portion, the elastic bands stretch and provide resistance against forcing the ball portion towards the second end of the arm. The number of elastic bands may be changed in order to provide varying degrees of tension depending upon the user of the device.

In yet another alternative embodiment of the baseball training and exercise apparatus 10, a means for applying a resistance to swinging a baseball bat or the like is provided. As illustrated in FIG. 3, the baseball training and exercise apparatus 10 may include a second arm 32 which may be positioned a predetermined distance above the first arm 8. The second arm has a first end coupled to the second supporting means 6 and a second end having a pulley or the like 34 attached thereto. A cable 38 is positioned at least partially around the pulley 34 such that one end of the cable is connected to a means for selectively securing the barrel of a baseball bat or the like 36 thereto and the other end of the cable is coupled to a means for providing resistance to swinging the baseball bat or the like.

The means for selectively securing the end of the cable 38 to the baseball bat 36 may be in the form of a cup or cylindrical member 39 which is dimensioned to fit over a portion of the bat. The cup 39 preferably includes means for selectively securing the cup to the bat. As illustrated in FIG. 3, the means for providing resistance coupled to the other end of the cable 38 may be a means for holding at least one weight plate 35. In this manner, the baseball player holding the bat must support the weight which is provided by the weight plates 16 coupled to the cable 38.

The embodiment shown in FIG. 3 may also be used to strengthen the shoulders and back muscles of a baseball player. The player may perform an exercise in which the cup is attached to the baseball bat or the like which is grasped with both hands at either end thereof. The exerciser should be positioned so that his arms are extended over his head and the baseball bat or the like is pulled down either in front of or behind the head of the exerciser. Thus, it may be necessary for the exerciser to kneel or sit on the floor in order to extend his arms so that a full pull down of the bat or the like can be accomplished.

The baseball training and exercise apparatus of the present invention can be used to improve batting skills as well as increase strength of the exerciser for more power when hitting. The advantage of the baseball training and exercise apparatus of the present invention is that a single exercise improves hand/eye coordination and strength at the same time.

For example, one method of using the baseball training and exercise apparatus 10 shown in FIG. 1 includes swinging a baseball bat or the like to contact the resiliently supported ball portion 12. When the ball portion is contacted by the baseball bat or the like, the ball portion is forced toward the second end of the arm 8 and the biasing means 20 within the arm provides a resistive force in a direction opposite to that supplied by the baseball bat or the like. Thus, the resiliently supported ball portion provides resistance against a full follow-through of the swing by the ball player.

This exercise improves hand/eye coordination since the ball player is swinging the bat to contact the ball portion 12 which is comparably sized to an official baseball. Furthermore, the batter's swing technique can also be improved by adjusting the height and angle of the arm 8 so that the ball portion 12 to be struck by the baseball bat is at different height levels and angles and the exerciser must adjust his swing accordingly. The resistance providedby the biasing means positioned within the arm 8 may improve the batter's strength by providing a force against the follow-through of the swing. More specifically, the batter should stand in a position such that the ball portion is contacted by the baseball bat or the like when the ball player's arms are fully extended. At the instant of contacting the ball portion 12, the ball player turns over his wrists in order to force the ball portion 12 towards the second end of the arm 8. Since a resistance is provided, the ball player's forearms and shoulders are strengthened by using the exercise apparatus of the present invention. This type of exercise is commonly known as isometric exercising whereby a resistive force is provided in a direction generally opposite to a force applied by an exerciser.

To further increase the strength of the exerciser, the apparatus shown in FIG. 3 may be used. The method of use is similar to that described above; however, additional resistance is provided by the cable 38 coupling the baseball bat or the like to a means for holding at least one weight plate 35. Thus, the ball player's strength is improved by both the resistance provided by the ball portion 12 and the resistance provided to swinging the baseball bat or the like. To further increase strength, the exerciser may swing slowly, supporting the weights coupled to the bat via the cable.

In an alternative method of using the baseball training and exercise apparatus 10 of the present invention, the ball player or exerciser will not take a complete swing to contact the ball portion. 12 of the apparatus. Instead, the baseball bat or the like is positioned against the ball portion 12 or bat receiving structure previously described such that the arms of the exerciser are extended in a direction substantially parallel to the floor. The bat is held so that it is also substantially parallel to the floor and the barrel of the bat is contacting the ball portion 12 or bat receiving structure. Once again, the wrists of the exerciser are turned over thereby applying a force to the bat striking assembly in a direction towards the second end of the arm 8. This isometric exercise will increase the strength of the exerciser's forearms and shoulders.

This exercise may also be performed using a baseball training and exercise apparatus 10 as shown in FIG. 3. The embodiment shown in FIG. 3 includes a cable attached at one end to a means for selectively coupling the cable to the barrel of the baseball bat or the like and the other end of the cable 38 having a means for applying a resistance to the exerciser swinging the baseball bat or the like.

Figure 4:
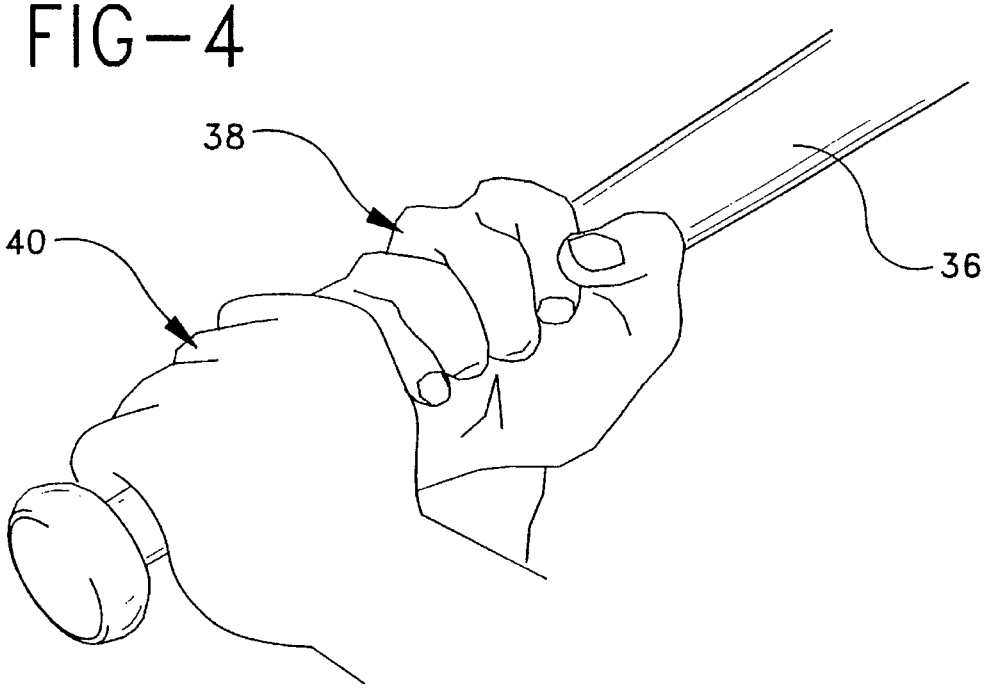
FIG. 4 illustrates an initial position of a baseball player's hands and wrists in performing an exercise using the baseball training and exercise apparatus formed in accordance with the present invention.
Figure 5:
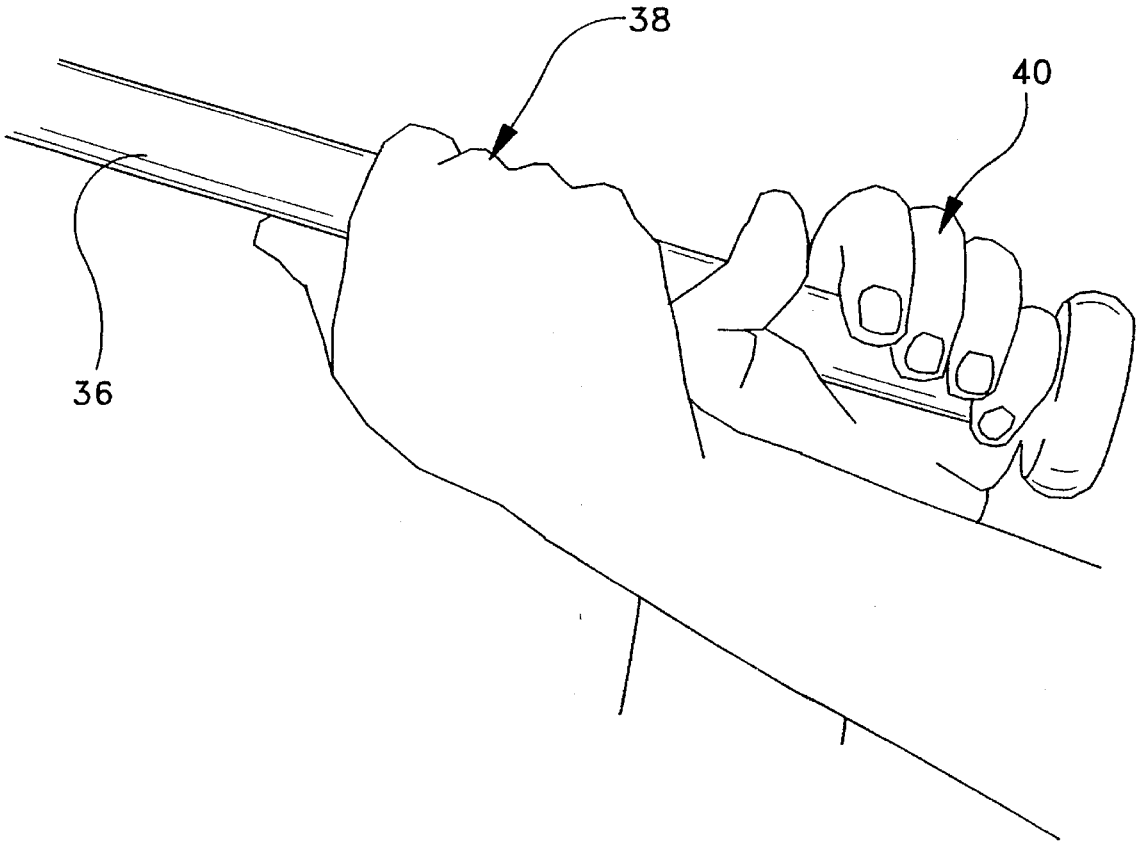
FIG. 5 illustrates a final position of a baseball player's hands and wrists in performing an exercise using the baseball training and exercise apparatus formed in accordance with the present invention.

FIGS. 4 and 5 clearly illustrate an initial and final position, respectively, of a baseball player's hands and wrists in performing an exercise using the baseball training and exercise apparatus of the present invention. More specifically, FIGS. 4 and 5 illustrate turning over one's wrists. FIG. 4 illustrates an initial position of the hands and wrists of a right-handed batter holding a baseball bat or the like 36 substantially parallel to the ground with his arms extended outwards. Referring to FIG. 5, it can be seen that once the wrists of the batter are turned over, the right hand 38 and arm are turned over the left hand 40 and arm to come to a final position as shown in FIG. 5. It is well known in the art of hitting a baseball, that power is generated by contacting the ball with the baseball bat such that at the point of contact the wrists of the batter are being turned over. Thus, the baseball training and exercise apparatus 10 of the present invention is designed to both increase batting skills as well as strengthen the forearms and shoulders of the ball player while performing a single exercise.

The baseball training and exercise apparatus of the present invention provides an apparatus for improving both batting skills and body strength. With respect to batting skills, hand/eye coordination is improved through the use of the baseball training and exercise apparatus. In addition, strength is increased by the isometric exercises which the exercise apparatus provides. In addition, the baseball training and exercise apparatus is simple in construction and may be easily assembled or disassembled. The components may be manufactured so that the entire apparatus may be disassembled and easily stored. Thus, the baseball training and exercise apparatus formed in accordance with the present invention provides a single exercise apparatus and method of exercising which improves both batting skills and strength which heretofore were improved using separate exercise devices and training.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A baseball batting exercise apparatus comprising:

a base;

a substantially vertical support coupled to said base;

a first arm having a first end coupled to said support and a second end, said first arm extending radially outward from said support;

a bat striking assembly, the bat striking assembly including a contact portion and means for resiliently supporting the contact portion, the bat striking assembly being mounted on and positioned near the second end of the first arm, said resilient supporting means providing resistance against a baseball bat striking said contact portion; and means for providing resistance to a baseball bat held by a user of the apparatus, said resistance means being coupled to said support and providing resistance against the user swinging the baseball bat.

2. A baseball batting exercise apparatus as defined in claim 1, wherein the resilient supporting means includes a spring.

3. A baseball batting exercise apparatus as defined in claim 1, wherein the resistance provided by said resilient supporting means is adjustable.

4. A baseball batting exercise apparatus as defined in claim 1, wherein the ball portion is dimensioned to be substantially the size of an official baseball.

5. A baseball batting exercise apparatus as defined in claim 1, wherein said first arm includes a stopper means mounted on said second end for preventing said ball portion from contacting the second end of said first arm.

6. A baseball batting exercise apparatus as defined in claim 1, wherein said support includes a first columnar portion and a second columnar portion adjustably mounted on the first columnar portion to allow the height of the support and said first arm to be adjusted.

7. A baseball batting exercise apparatus as defined in claim 1, wherein the first arm is pivotally mounted on the support to adjust the angle of the arm.

8. A baseball batting exercise apparatus as defined in claim 1, wherein said base further includes means for holding at least one weight plate.

9. A baseball batting exercise apparatus as defined in claim 1, wherein the baseball bat resistance providing means comprises a second arm coupled to said support and extending outwardly therefrom, a pulley coupled to the second arm, a cable positioned at least partially around said pulley and having a first end and an opposite second end, means for holding at least one weight plate mounted on the first end of the cable, and means for securing a baseball bat to the second end of the cable.

10. A baseball batting exercise apparatus as defined in claim 1, wherein the bat securing means includes a cylindrical member by which a portion of the baseball bat is removably received.

* * * * *